United States Patent [19]

Reedy

[11] Patent Number: 4,804,343

[45] Date of Patent: Feb. 14, 1989

[54] LAMP SOCKET ASSEMBLY

[75] Inventor: Patrick J. Reedy, Youngstown, Ohio

[73] Assignee: General Motors Corporation, Detroit, Mich.

[21] Appl. No.: 179,772

[22] Filed: Apr. 11, 1988

[51] Int. Cl.[4] ..... H01R 19/00

[52] U.S. Cl. ..... 439/854; 439/318; 439/336; 439/602

[58] Field of Search ..... 439/279, 298, 318, 336, 439/356, 357, 366, 556–559, 602, 605, 854, 855

[56] References Cited

U.S. PATENT DOCUMENTS

| | | | |
|---|---|---|---|
| 3,800,267 | 3/1974 | Burgess et al. | 439/336 X |
| 3,982,813 | 9/1976 | Cope et al. | 339/127 R |
| 3,999,095 | 12/1976 | Pearce et al. | 439/366 X |
| 4,752,241 | 6/1988 | Matsuoka et al. | 439/558 X |
| 4,752,710 | 6/1988 | Devir et al. | 439/619 X |

OTHER PUBLICATIONS

Sketch, "Micro-Dot Lamp Socket", initialed D. J. K., 3/10/86.

*Primary Examiner*—Eugene F. Desmond
*Attorney, Agent, or Firm*—Edward J. Biskup

[57] ABSTRACT

A lamp socket assembly which includes a plastic socket body having a tubular portion adapted to receive a socket insert along a first axis and having a connector portion integral therewith which receives the wire terminals along a second axis which is substantially perpendicular to the first axis.

9 Claims, 3 Drawing Sheets

LAMP SOCKET ASSEMBLY

The invention concerns lamp sockets and more particularly relates to a right angle plastic lamp socket in which the wire terminals are connected to the bulb contacts through a terminal housing formed generally perpendicularly to the bulb longitudinal center line.

Conventional lamp sockets of the type that this invention generally relates to use wire terminals that mate axially with the socket feed and ground terminals making it necessary to have the blades of the latter terminals to be assembled to the socket body before the wire terminal is mated thereto. Since the column strength of the wire connected to the wire terminals is not sufficient to mate the terminals without buckling, some type of terminal holder must be used during the assembly process. The holder must then be sealed to the socket body and the cable sealed to the holder. This adds parts, complexity and cost to conventional lamp socket design.

The present invention differs from the above described conventional lamp socket in that the wire terminal utilizes a perpendicular mating direction with the socket terminals. In addition, the mating of the wire and socket terminals occurs after the wire terminals are assembled to the socket body thereby reducing the insertion force required and eliminating the need for a special terminal holder. This allows the cable to be sealed directly to the socket body and simplifies the lamp socket design and reduces cost.

In the preferred form, the lamp socket assembly according to the present invention includes a plastic socket body having a tubular portion adapted to receive a socket insert along a first axis and having a generally rectangular connector portion for receiving the wire terminals along a second axis which is substantially perpendicular to the first axis. The socket insert is generally cylindrical in configuration having a front end for receiving a snap-in wedge type lamp bulb and rigidly carries a pair of feed terminals and a single ground terminal for electrical engagement with the contacts of the lamp bulb. Each of the feed terminals and the ground terminal have an integral blade member projecting outwardly from the rear end of the socket insert along an axis substantially parallel to the longitudinal center axis of the socket insert. The connector portion of the socket body has three elongated cavities formed therein for receiving wire terminals along axes which are parallel to the second axis. The cavities serve as guide tunnels for positioning the wire terminals within the socket body so when the socket insert is inserted axially along the first axis into the tubular portion. The blade member of each of the feed terminals and the ground terminal mates with the receptacle portion of the wire terminals for providing electrical current to the lamp bulb.

The objects of the present invention are to provide a new and improved lamp socket assembly that is inexpensive to assemble and has the wire terminals mating with the feed and ground terminals along axes which are mutually perpendicular to each other; to provide a new and improved lamp socket assembly having a design which limits the amount of special tools required to assemble the various parts of the lamp socket; to provide a new and improved lamp socket assembly in which the focal length can be changed by substituting only one part, the socket body, with all other parts remaining the same: to provide a new and improved lamp socket assembly in which terminal positioning is assured through normal assembly without requiring special designed pieces or the need for taking measurements; and to provide a new and improved lamp socket assembly having an L-shaped socket body which includes a tubular portion located along a first axis and adapted to receive s cylindrical socket insert provided with spaced and firmly secured feed and ground terminals and including a generally rectangular connector portion located along a second axis which is substantially perpendicular to the first axis and is formed with a plurality of side-by-side elongated cavities each of which is adapted to receive a wire terminal which automatically mates with the feed and ground terminals to provide an electrical connection when the socket insert is inserted into the tubular portion of the socket body.

Other objects and advantages of the present invention will be more apparent from the following detailed description of the invention when taken with the drawings in which FIG. 1 is a side elevational view of a lamp socket assembly made according to the present invention;

Figure 1:
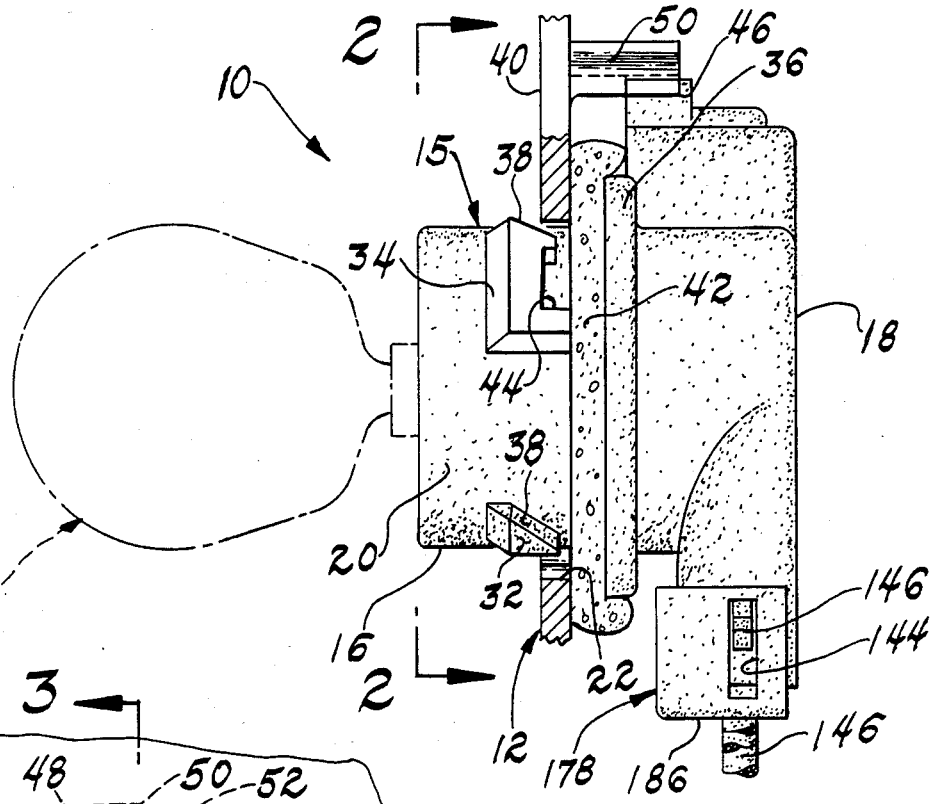
Figure 2:
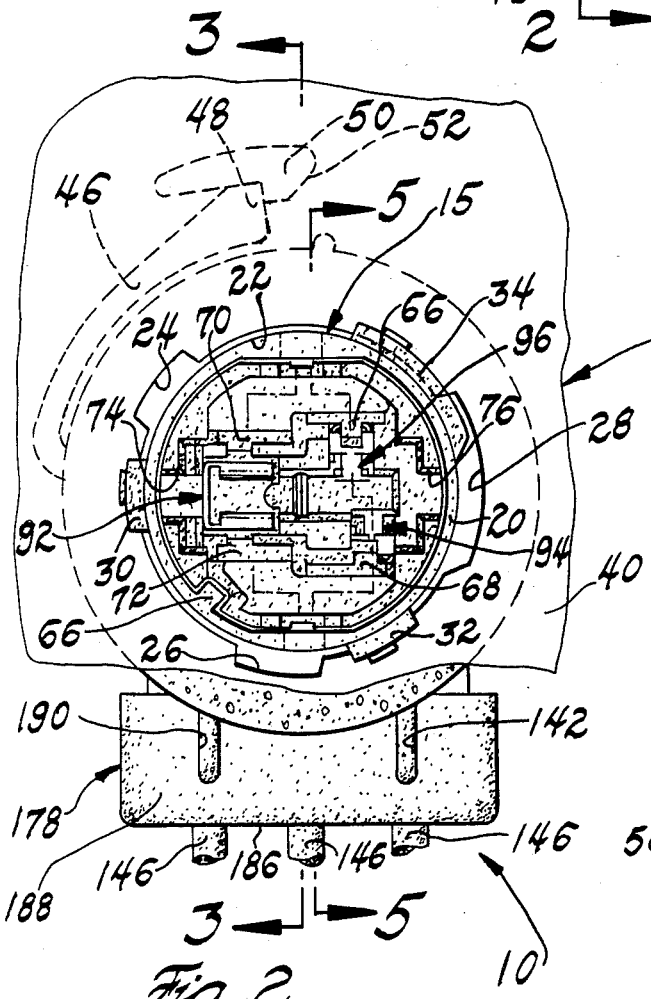
FIG. 2 is a front elevational view of the lamp socket assembly taken on line 2—2 of FIG. 1.
Figure 3:
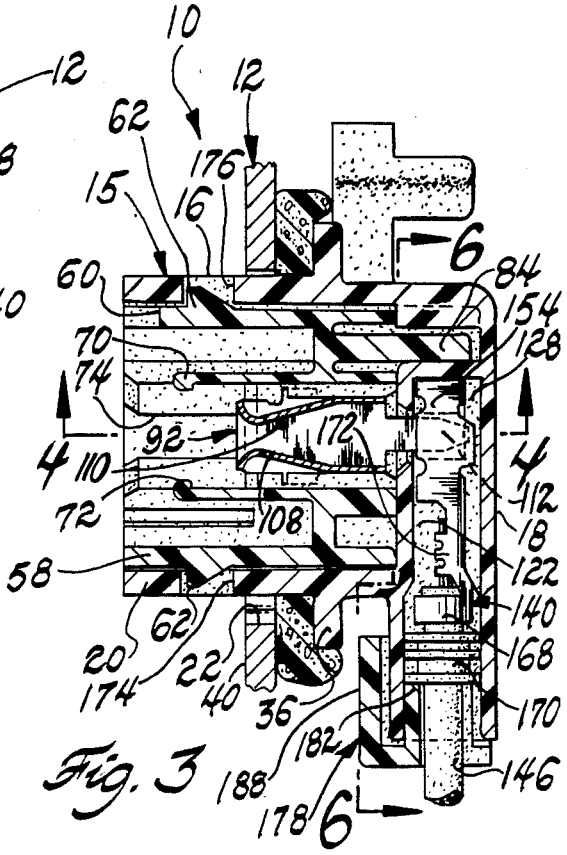
FIG. 3 is a sectional view of the lamp socket assembly taken on line 3—3 of FIG. 2.

Referring nov to the drawings and more particularly to FIGS. 1, 2 and 3 thereof, a lamp socket assembly 10 is shown mounted in a rear panel portion 12 of a lamp housing (such as employed in tail lamp assemblies or side marker lamps of a motor vehicle) for locating an electrically energizable lamp bulb 14 in a desired axial and rotational position with respect to the optical components of the lamp housing. The lamp socket assembly 10 is suitable for such applications wherein the rear panel portion 12 is in an exposed position subject to all weather conditions thereby requiring an effective seal between the lamp socket assembly 10 and the panel portion 12.

As alluded to, the panel portion 12 forms the rear wall of a sealed lamp housing in which the lamp bulb 14 must be accurately positioned with respect to a reflex lens and/or the parabolic reflector for directing light from the lamp housing when the lamp bulb 14 is energized. Typically, the rear surface of the lamp housing will be located in close proximity to a vehicle body component. As a result, the lamp socket assembly 10 according to the present invention includes a 90° socket body 15 consisting of a generally tubular portion 16 and a generally rectangular connector portion integrally formed therewith. The tubular portion 16 is formed with a cylindrical outer peripheral wall 20 that is of slightly less diameter than a central circular mounting hole 22 in the panel portion 12. The mounting hole 22, as best seen in FIG. 2, further includes a pair of radially outwardly directed clearance slots 24 and 26 and a third indexing and clearance slot 28 of greater arcuate extent than the slots 24 and 26, each of which has the same arcuate extent.

The slots 24–28 as configured, define an indexed array so that the socket body 15 will fit only one way axially through the mounting hole 22. Retention ears 30, 32 and 34 are formed on the periphery of the wall 20 of the tubular portion 15 and extend axially beyond a ring-like flange 36 integrally formed with the tubular portion 15. Each of the ears 30, 32, and 34 has a generally trapozoidal configuration when viewed from the front and a lead taper 38 thereon which facilitates fit of the socket body 15 into the mounting hole 22. The lead taper 38 is adapted to engage the clearance slots 24–28 at the perimeter of the mounting hole 22 so that the socket body 15 will be easily aligned for axial insertion to a point where the rear wall on each of the retention ears 30–34 will be located axially inwardly of the inner surface 40 of the panel portion 12 prior to final torque application for assembly to the lamp housing.

As seen, the tubular portion 15 has an annular gasket 42 supported thereon adjacent the flange 36. The gasket 42 has a thickness which is adapted to produce an interference fit between the panel portion 12 and the flange 36 when the socket body 15 is located within the mounting hole 22. In this regard, it will be noted that, during the installation of the lamp socket assembly 10 to the panel portion, the retention ears 30–34 are first axially aligned with the associated clearance slots 24–28 after which the lamp socket is moved axially into the mounting hole 22 until the ears 30–34 are located axially inwardly of the inner surface 40 of the panel portion 12. The lamp socket assembly 10 is then rotated clockwise to a locked position during which time the ears 30–34 pull the gasket 42 into a tight sealed relationship with the mounting hole 22. The locked position of the lamp socket assembly 10 is attained when a stop surface 44 on the ear 34 contacts the side edge of clearance slot 28. At the same time, a resilient lock arm 46 integrally formed with the tubular portion 16 has a catch 48 which rotates beyond a lock member 50 during which time it is compressed radially inwardly by a ramp 52 formed on the lock member 50 and afterward snaps radially outwardly into engagement with a notch formed on the lock member 50.

Figure 6:
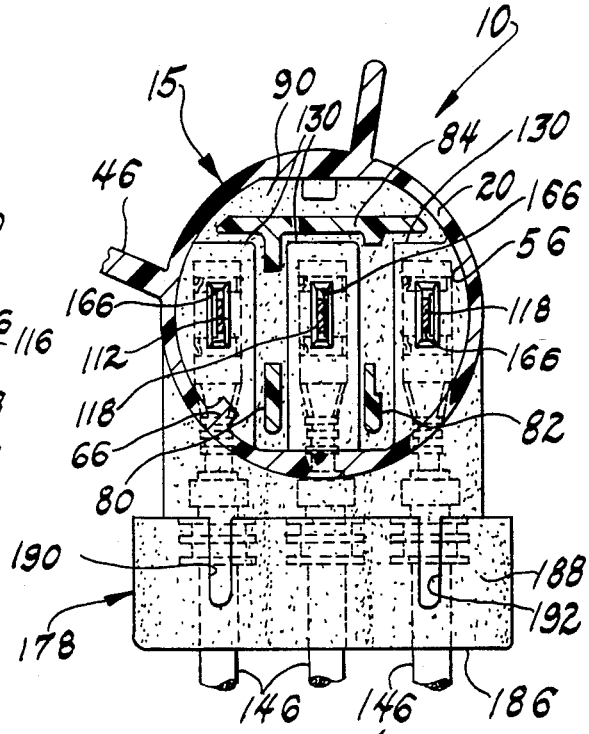
FIG. 6 is a sectional view taken on line 6—6 of FIG. 3
Figure 7:
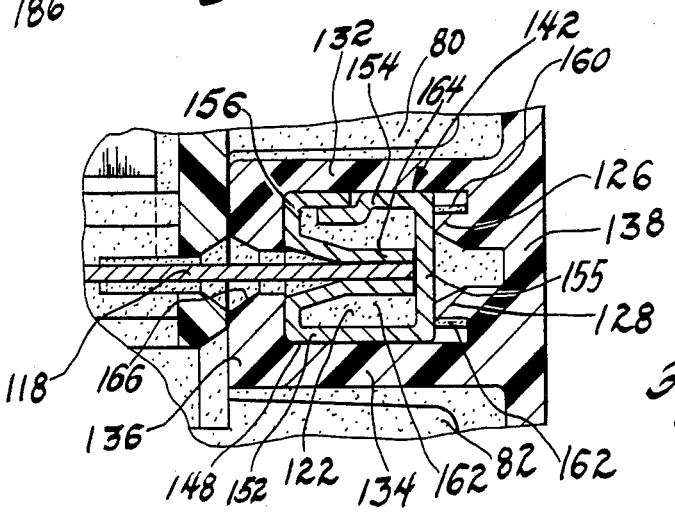
FIG. 7 is an enlarged view of one of the cavities in the connector portion of the lamp socket assembly as seen in FIG. 4.
Figure 8:
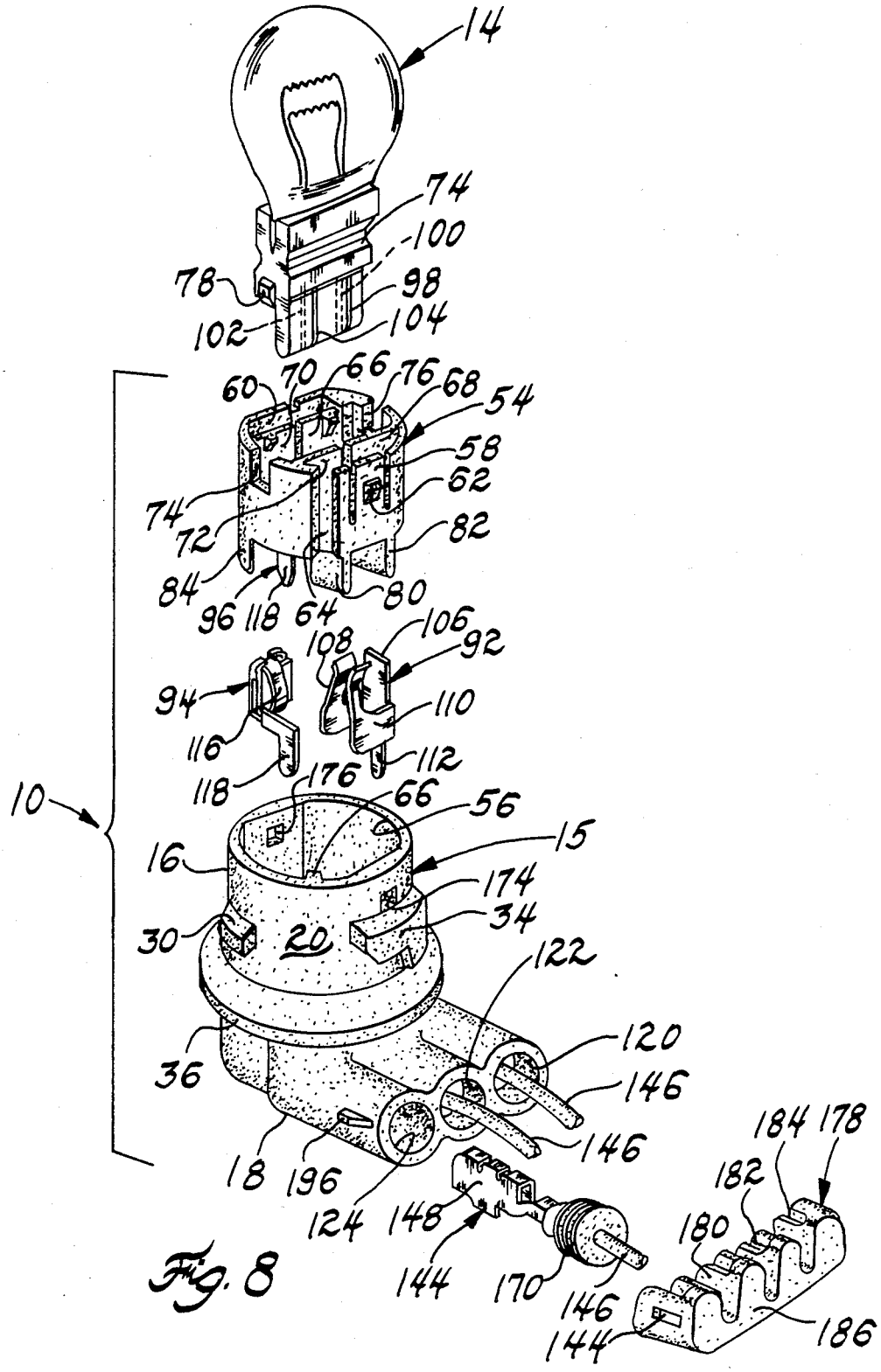
FIG. 8 is an exploded view of the lamp socket assembly shown in FIGS. 1–7.

The lamp bulb 14 of the lamp socket assembly 10 is adapted to be mounted within a separate socket insert 54 which is insertable into and removably supported within a circular opening 56 formed in the tubular portion 16 of the socket body 15. As seen in FIG. 7, the socket insert 54 is generally cylindrical in configuration and includes a pair of diametrically opposed flexible arms 58 and 60, each of which is formed with a tapered catch 62. An index slot 64 is formed on the peripheral outer surface of the socket insert 54 and cooperates with a rib 66 formed on the inner diameter of wall 20 of the tubular portion 15 for proper positioning of the socket insert 54 within the tubular portion 15. The socket insert 54 is also integrally formed with four flexible lock members 66, 68. 70 and 72 located ; opposed pairs and provided with the usual catch members which are adapted to snap into the opposed channels (one of which is identified by reference numeral 74) formed on the wedge type lamp bulb 14. Lamp bulbs of this type are identified in the trade as No. 2358 and No. 2457. The lock members 66–72 serve to retain the bulb 14 within the socket insert 54. In this regard, a pair of diametrically opposed slots 74 and 76 formed in the socket insert 54 serve to receive a pair of opposed guide tabs (one of which is identified by reference numeral 78) formed on the lamp bulb 14 so as to assure proper insertion of the lamp bulb 14 into the socket insert 54. The rear end or base of the socket insert is formed with three integral legs 80, 82 and 84 which project outwardly therefrom. As best seen in FIG. 6, when the socket insert 54 is assembled to the socket body 15, the legs 80 and 82 are located within a pair of channels 86 and 88 formed within the connector portion 18 of the socket body 15. The leg 84, on the other hand, extends into and is received by a well 90 also formed in the connector portion of the socket body.

Figure 4:
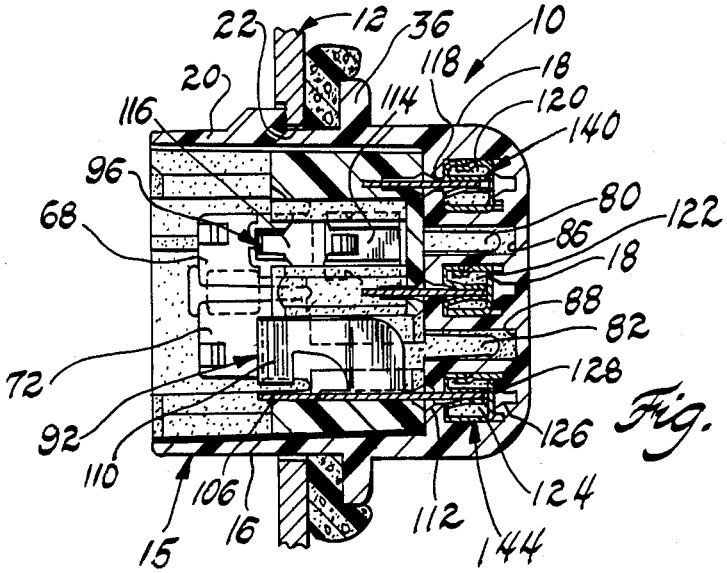
FIG. 4 is a sectional view of the lamp socket assembly taken on line 4—4 of FIG. 3
Figure 5:
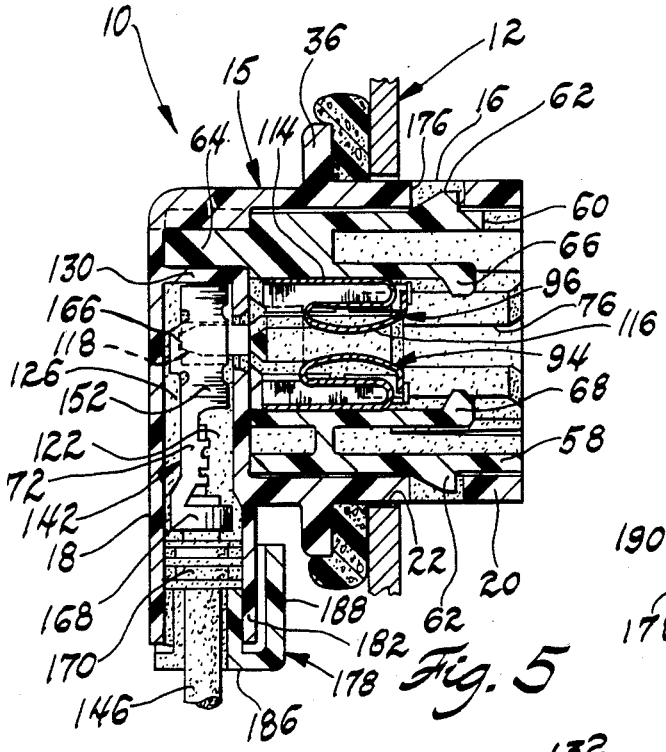
FIG. 5 is a sectional view of the lamp socket assembly taken on line 5—5 of FIG. 2.

The socket insert 54 serves to carry a ground terminal 92 and a pair of identical feed terminals 94 and 96 which are adapted to make electrical contact with the terminals 98, 100, 102 and 104 of the lamp bulb 14. As seen in FIGS. 3 and 4, the ground terminal 92 is firmly mounted within a ground cavity formed in the socket insert 54 and (as seen in FIG. 7) comprises a base section 106 formed integrally with a pair of opposed cantilevered contacts 108 and 110. The base section 106 includes an integral blade 112, the end portion of which is tapered so as to provide a slightly pointed end which extends outwardly a distance substantially equal to the length of the legs 80–84. As best seen in FIGS. 4 and 5, each of the feed terminals 94 and 96 are also firmly mounted within suitable feed terminal cavities formed in the socket insert 54 and each feed terminal 94 and 96 includes a base section 114 integrally formed with a double-looped contact portion 116 as best seen in FIG. 5. As in the case with the ground terminal 92, the base section 114 of each feed terminal is integrally formed with a blade 118 which extends outwardly from the base of the socket insert the same distance as the ground terminal blade 112. Also as in the case of the ground terminal 92, the end portion of the blade 118 is tapered so as to form a pointed end.

Referring once again to the socket body 15, as best seen in FIGS. 3 through 6, the rectangular connector portion 18 thereof is formed with three laterally spaced and parallel elongated cavities 120, 122 and 124, each of which is located along an axis substantially perpendicular to the center longitudinal axis of the tubular portion 16 of the socket body 15. As best seen in FIG. 5, the entrance end of each of the cavities 120–124 is circular in cross section for a short distance into the connector portion 18 after which each of the cavities 120–124 is generally square in cross section as seen in FIG. 4 and includes a pair of laterally spaced ribs 126–128. In this regard, it will be noted that the portions of each of the cavities 120–124 which are square in cross section are located in alignment with the tubular portion 16 as seen in FIG. 6. Also, as seen in FIGS. 4, 5, 6 and 7, each of the cavities 120–124 aligned as indicated with the tubular portion 16 is defined by an end wall 13D, a pair of side walls 132 and 134, a front wall 136. and a back wall 138. The back wall 138 of each of the cavities 120–124 are interconnected and constitute the back wall of the connector portion 18 of the socket body 15.

The cavities 120–124 are designed to receive a pair of wire terminals 140 and 142 for providing electrical current to the feed terminals 94 and 96 and a wire terminal 144 for connection with the ground terminal 92. Each of the terminals 140–144 are identical in construction and is electrically connected to a wire, in the form of a plurality of wire strands, encased within a cable 146. More specifically, as seen in FIGS. 3, 5, 7, and 8, each terminal 140–144 includes a receptacle portion 148 and an integral attachment portion 150. The receptacle portion 148, as best seen in FIG. 7, is generally square in cross section and conforms in size to the associated cavity so as to be snugly insertable into the square portion of the accommodating cavity. More specifically, the receptacle portion 148 of each terminal includes a pair of side walls 152 and 154, a front wall 156, and a back wall 158. Each side wall is formed with an outwardly extending tab 160 which is located in the plane of the associated side wall 152 and 154. Thus, as seen in FIG. 7, the tabs 160 of the side walls 152 and 154 cooperate with the ribs 126 and 128 in the associated cavity to assure that the receptacle portion 148 of each wire terminal 140–144 can only be inserted with its front wall 156 adjacent the front wall 136 integrally formed with the socket body 15. A pair of flexible contacts 162 and 164 are connected with the side walls 152 and 154, respectively, and extend side by side in engagement with each other into the enclosed portion of the receptacle portion 148. The contacts 162 and 164 are positioned on the receptacle portion 148 of each of the terminals 140–144 so when the latter is fully inserted into the accommodating cavity and engages the end wall 130 thereof, the contacts 162 and 164 register with a slot 166 formed in the front wall 136 formed with the socket body 15 as seen in FIG. 7.

The attachment portion of each wire terminal 140–144 includes a ring portion 168 crimped over a cable seal 170 to mechanically connect the latter to the associated cable 146. A bridge portion 172 is integral with and connects the ring portion 168 to the receptacle portion 148 and takes the form of a trough with a plurality of wing member permitting the bare wire strands to be located therein and mechanically connected to receptacle portion 148 by the crimped wing members and, if desired, also soldered thereto so as to assure a positive electrical connection therewith.

During the assembly operation of the lamp socket assembly 10 as seen in FIG. 7, the three wire terminals 140–144 are first inserted into the cavities 120–124 of the connector portion 18 of the socket body 15 resulting in the contacts 162 and 164 of each terminal 140–144 being positioned in alignment with the slot 166 in the associated front wall 136. In this position, the cable seal 170 is located in the cylindrical portion of the associated cavity and serves to weatherseal the lower end of the connector portion 18 of the socket body 15. With the terminals 140–144 properly positioned within the accommodating cavities 120–124, the socket insert 54 with the feed terminals 94 and 96 and the ground terminal 92 firmly mounted therein is then inserted axially into the opening 56 of tubular portion 16 of the socket body 15 with the slot 64 on the socket insert 54 registering with rib 66 formed in on the cylindrical opening 56 of the tubular portion 16 of the socket body 15. It will be understood that the socket insert 54 is designed so that the blades 112 and 118, formed with the ground terminal 92 and the feed terminals 94, respectively, after being secured into the socket insert 54, are positioned and spaced from each other so that they will register with the three slots 166 formed in the front walls 136 of the connector portion 18 as seen in FIG. 6. As a result, when the socket insert 54 is moved axially into the cylindrical opening 56 of the tubular portion 16, the blades 112 and 118 pass through the appropriate slots 166 into electrical engagement with the contact portions 162 and 164 of the wire terminals 140–144. At the same time. The catches 62 on the spring arms 58 and 60 move into the diametrically opposed holes 174 and 176 formed on the tubular portion 16 for maintaining the socket insert 54 within the tubular portion 16 of the socket body 15. It will be noted that the mating of the blades 112 and 118 with the terminal 140–144 occurs with the axes of the blades 112 and 118 perpendicular to the axes of the terminals 140–144. As a result, the blades 112 and 118 help to retain the terminals 140–144 within the socket body 15.

Although not required, additional assurance that the terminals 140–144 will be retained in the socket body 15 can be provided by the use of a cable lock 178. The cable lock 178 is made from a plastic material and is integrally formed with three identical and laterally spaced semi-cylindrical projections 180, 182 and 184 which extend vertically upwardly from a base 186 as seen in FIGS. 3 and 5. A front wall 188 is formed with the base 186 and has two identical vertical slots 190 and 192 therein so as to allow outward flexing of the opposed side portions of the wall 188, each of which is formed with an elongated, vertically oriented opening 194 adapted to be snapped over and mate with a tapered catch 196 integral with the connector portion 18 adjacent the lower end as seen in FIGS. 1 and 2. Thus, when the cable lock 178 is joined to the lower end of the connector portion 18, the projections 180–184 register with and move into the cylindrical portions of the cavities 120–124 and the side portions of the wall 188 snap into locked engagement with the catches 196 resulting in the cable lock 178 being located on the connector portion 18 as seen in FIGS. 1 and 3.

Various changes and modifications can be made in the construction of this lamp socket assembly without departing from the spirit of the invention. Such changes and modifications are contemplated by the inventor and he does not wish to be limited except by the scope of the appended claims.

The embodiments of the Invention In which an exclusive property or privilege is claimed are defined as follows:

1. A lamp socket assembly including a plastic socket body having a tubular portion for receiving a socket insert along a first axis and having a connector portion for receiving a plurality of female wire terminals along a second axis which is substantially perpendicular to the first axis, said socket insert having a front end provided with a feed terminal and a ground terminal for electrical engagement with the contacts of a lamp bulb, each of said terminals having an integral blade member projecting outwardly from the rear end of said socket insert along axes substantially parallel to the longitudinal center axis of said socket insert, and said connector portion having spaced cavities formed therein for receiving said wire terminals along axes parallel to said second axis and for positioning said wire terminals in the socket body so when said socket insert is axially inserted into said tubular portion along said first axis, said blade member of each of said feed terminal and said ground contact mate with said wire terminals for providing electrical current to said lamp bulb.

2. A lamp socket assembly including a plastic socket body having a tubular portion for receiving a socket insert along a first axis and having a connector portion for receiving a plurality of female wire terminals along a second axis which is substantially perpendicular to the first axis, said socket insert being cylindrical in configuration and having a front end provided with a pair of feed terminals and a ground terminal for electrical engagement with the contacts of a lamp bulb, each of said feed terminals and said ground terminal having an integral blade member projecting outwardly from the rear end of said socket insert along spaced axes each of which is substantially parallel to the longitudinal center axis of said socket insert, and said connector portion having three laterally spaced and generally square cavities formed therein for receiving said wire terminals along axes parallel to said second axis and for positioning the latter in the socket body so when said socket insert is axially inserted into said tubular portion along said first axis, said blade member of each of said feed terminals and said ground contact mate with said wire terminals for providing electrical current to said lamp bulb.

3. A lamp socket assembly including a plastic socket body having a tubular portion formed with a circular opening for receiving a socket insert along a first axis and having a connector portion for receiving a plurality of female wire terminals along a second axis which is substantially perpendicular to the first axis, said socket insert being cylindrical in configuration and having a front end provided with a pair of feed terminals and a ground terminal for electrical engagement with the contacts of a snap-in wedge type lamp bulb, each of said feed terminals and said ground terminal having an integral blade member projecting outwardly from the rear end of said socket insert along spaced axes each of which is substantially parallel to the longitudinal center axis of said socket insert, and said connector portion having three laterally spaced and generally square cavities formed therein for receiving said wire terminals along axes parallel to said second axis and for positioning the latter in the socket body so when said socket insert is axially inserted into said tubular portion along said first axis, said blade member of each of said feed terminals and said ground contact mate with said wire terminals for providing electrical current to said lamp bulb, and said socket insert and said tubular portion having cooperating means for locking said socket insert in said opening of said tubular portion when said socket insert is inserted into said tubular portion.

4. The lamp socket assembly set forth in claim 3 wherein each of said cavities in said connector portion is generally circular at its entrance end and generally square in cross section in the area defined by said circular opening in the tubular portion of the socket body.

5. The lamp socket assembly set forth in claim 4 wherein each of said cavities in the area of said tubular portion is defined by a pair of side walls, an end wall, a front wall, and a back wall.

6. The lamp socket assembly set forth in claim 5 wherein the front wall faces the open end of the circular opening in the tubular member and is formed with a slot for allowing said blade member to extend into the receptacle portion of the wire terminal located in the associated cavity.

7. The lamp socket assembly set forth in claim 3 wherein said cooperating means for locking said socket insert in said tubular portion includes a pair of spring arms integrally formed with the socket insert and a pair of diametrically opposed openings formed in the tubular portion.

8. The lamp socket assembly set forth in claim 3 wherein said circular opening in said tubular portion and the outer peripheral portion of the socket insert are formed with cooperating means for properly indexing said socket insert during the insertion of the latter into the tubular portion.

9. The lamp socket assembly set forth in claim 8 wherein said cooperating means is a rib formed on the inside diameter of said tubular portion and a slot formed in the outer peripheral portion of the socket insert.

* * * * *